US006722965B2

(12) United States Patent
Zuniga et al.

(10) Patent No.: US 6,722,965 B2
(45) Date of Patent: Apr. 20, 2004

(54) CARRIER HEAD WITH FLEXIBLE MEMBRANES TO PROVIDE CONTROLLABLE PRESSURE AND LOADING AREA

(75) Inventors: Steven M. Zuniga, Soquel, CA (US); Hung Chih Chen, San Jose, CA (US); Ming Kuie Tseng, San Jose, CA (US)

(73) Assignee: Applied Materials Inc., Santa Clara, CA (US)

( * ) Notice: Subject to any disclaimer, the term of this patent is extended or adjusted under 35 U.S.C. 154(b) by 90 days.

(21) Appl. No.: 09/903,226

(22) Filed: Jul. 10, 2001

(65) Prior Publication Data

US 2002/0039879 A1 Apr. 4, 2002

Related U.S. Application Data

(60) Provisional application No. 60/217,633, filed on Jul. 11, 2000, and provisional application No. 60/237,092, filed on Sep. 29, 2000.

(51) Int. Cl.[7] ..... B24B 1/00

(52) U.S. Cl. ..... 451/288; 457/41; 457/285; 457/397; 457/398

(58) Field of Search ..... 451/285, 289, 451/397, 398, 41

(56) References Cited

U.S. PATENT DOCUMENTS

| | | | |
|---|---|---|---|
| 4,373,991 | A | 2/1983 | Banks |
| 4,918,869 | A | 4/1990 | Kitta |
| 5,081,795 | A | 1/1992 | Tanaka et al. |
| 5,193,316 | A | 3/1993 | Olmstead |
| 5,205,082 | A | 4/1993 | Shendon et al. |
| 5,230,184 | A | 7/1993 | Bukhman |
| 5,423,558 | A | 6/1995 | Koeth et al. |
| 5,423,716 | A | 6/1995 | Strasbaugh |
| 5,441,444 | A | 8/1995 | Nakajima |

(List continued on next page.)

FOREIGN PATENT DOCUMENTS

| | | |
|---|---|---|
| DE | 86 31 087.9 | 4/1987 |
| EP | 0 156 746 A1 | 10/1985 |
| EP | 0 653 270 A1 | 5/1995 |
| EP | 0 841 123 A1 | 5/1998 |
| JP | 61-25768 | 2/1986 |
| JP | 63-114870 | 5/1988 |
| JP | 63-300858 | 12/1988 |
| JP | 1-216768 | 8/1989 |
| JP | 2-224263 | 9/1990 |
| JP | 2-243263 | 9/1990 |
| JP | 05 277929 | 10/1993 |
| WO | WO 96/36459 | 11/1996 |
| WO | WO 99/02304 | 1/1999 |
| WO | WO 99/07516 | 2/1999 |

OTHER PUBLICATIONS

U.S. patent application Ser. No. 09/470,820.

*Primary Examiner*—George Nguyen
(74) *Attorney, Agent, or Firm*—Fish & Richardson

(57) ABSTRACT

A carrier head for a chemical mechanical polishing apparatus includes a flexible membrane that applies a controllable load to a substrate in an area with a controllable inner diameter.

17 Claims, 13 Drawing Sheets

U.S. PATENT DOCUMENTS 5,443,416 A 8/1995 Volodarsky et al.
5,449,316 A 9/1995 Strasbaugh
5,476,414 A 12/1995 Hirose et al.
5,498,199 A 3/1996 Karlsrud et al.
5,584,751 A 12/1996 Kobayashi et al.
5,624,299 A 4/1997 Shendon
5,643,053 A 7/1997 Shendon
5,643,061 A 7/1997 Jackson et al.
5,738,574 A 4/1998 Tolles et al.
5,759,918 A 6/1998 Hoshizaki et al.
5,762,539 A 6/1998 Nakashiba et al.
5,762,544 A 6/1998 Zuniga et al.
5,803,799 A 9/1998 Volodarsky et al.
5,851,140 A 12/1998 Barns et al.
5,879,220 A 3/1999 Hasegawa et al.
5,957,751 A 9/1999 Govzman et al.
5,964,653 A * 10/1999 Perlov et al. ..... 451/288
6,056,632 A 5/2000 Mitchel et al.
6,080,050 A 6/2000 Chen et al.
6,110,026 A 8/2000 Arai
6,116,992 A 9/2000 Prince
6,162,116 A 12/2000 Zuniga et al.
6,210,255 B1 * 4/2001 Zuniga ..... 451/41
6,361,419 B1 * 3/2002 Zuniga et al. ..... 451/287
6,422,927 B1 * 7/2002 Zuniga ..... 451/288
6,494,774 B1 * 12/2002 Zuniga et al. ..... 451/398

* cited by examiner

CARRIER HEAD WITH FLEXIBLE MEMBRANES TO PROVIDE CONTROLLABLE PRESSURE AND LOADING AREA

CROSS-REFERENCE TO RELATED APPLICATIONS

This application claims priority to Provisional U.S. Application Serial No. 60/217,633, filed Jul. 11, 2000 and to Provisional U.S. Application Serial No. 60/237,092, filed Sep. 29, 2000, both of which are incorporated herein by reference in their entirety.

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface can present problems in the photolithographic steps of the integrated circuit fabrication process. Therefore, there is a need to periodically planarize the substrate surface. In addition, planarization is needed when polishing back a filler layer, e.g., when filling trenches in a dielectric layer with metal.

Chemical mechanical polishing (CMP) is one accepted method of planarization. This planarization method typically requires that the substrate be mounted on a carrier or polishing head. The exposed surface of the substrate is placed against a moving polishing pad, such as a circular pad or linear belt. The polishing pad may be either a "standard" or a fixed-abrasive pad. A standard polishing pad has a durable roughened or soft surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-active agent, and abrasive particles if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is non-uniform polishing. Due to a variety of factors, some portions of the substrate tend to be polished at a different rate than other parts of the substrate. This non-uniform polishing can occur even if a uniform pressure is applied to the backside of the substrate. In addition, a substrate arriving at the polishing apparatus may have an initial thickness that is non-uniform. Therefore it is desireable to provide a carrier head that can apply different pressures to different regions of the substrate during chemical mechanical polishing to compensate for non-uniform polishing rates or for non-uniformity in the initial thickness of the substrate.

An example of non-uniform polishing is the so-called "center fast effect", i.e., the tendency of the central region of the substrate to be polished faster than the outer region of the substrate.

SUMMARY

In one aspect, the invention is directed to a carrier head for a chemical mechanical polishing apparatus. The carrier head has a carrier structure, a first flexible membrane extending below the carrier structure, and a plurality of chambers between the first flexible membrane and the carrier structure. A bottom surface of the flexible membrane provides a substrate-mounting surface. The plurality of chambers are configured to apply a first pressure to a substrate in an annular loading area having an inner diameter, and the plurality of chambers permit control of the first pressure applied to the substrate in the loading area and the inner diameter of the annular loading area.

Implementations of the invention may include one or more of the following features. The plurality of chambers may be configured to apply a second pressure to the substrate in a central loading area surrounded by the annular loading area. The second pressure may be less than the first pressure. A second flexible membrane may be positioned between the first flexible membrane and the carrier structure. The second flexible membrane may include a first membrane portion which can be brought into contact with an inner surface of the first flexible membrane, and a second membrane portion may be connected to a central section of the first membrane portion and define a first chamber. Evacuation of the first chamber may draw the second membrane portion upwardly and may pull the central section of the first membrane portion away from first flexible membrane to increase an inner diameter of an annular section of the first membrane portion that contacts the first flexible membrane. A third membrane portion may be connected to an edge section of the first membrane portion and may define a second chamber. Evacuation of the second chamber may draw the third membrane portion upwardly and may pull the edge section of the first membrane portion away from first flexible membrane to reduce an outer diameter of the annular section of the first membrane portion in contact with the first flexible membrane. The first flexible membrane may include an outer membrane portion to contact the substrate and an inner membrane portion joined to a central section of the outer membrane portion and defining a first chamber. Evacuation of the first chamber may draw the inner membrane portion upwardly and may pull the central section of the outer membrane portion away from the substrate to increase an inner diameter of an annular section of the outer membrane portion that contacts the substrate. Pressurization of the second chamber may push the inner membrane portion outwardly to contact the first membrane portion. There may be a fluid connection to a volume between the central section of the outer membrane and the substrate.

In another aspect, the invention is directed to a carrier head for a chemical mechanical polishing apparatus. The carrier head has a carrier structure, a first flexible membrane having a perimeter portion connected to the carrier structure and a central portion with a lower surface that provides a substrate mounting surface, and a second flexible membrane having a central portion secured to the carrier structure, a perimeter portion secured to the carrier structure, an annular flap secured to the carrier structure, and a middle portion having a lower surface that contacts an upper surface of the central portion of the first flexible membrane in an annular region. A first volume between the first flexible membrane and the second flexible membrane provides a first chamber, a second volume between the second flexible membrane and the carrier structure inside the annular flap provides a second chamber, and a third volume between the second flexible membrane and the carrier structure between the annular flap and the perimeter portion provides a third chamber.

Implementations of the invention may include one or more of the following features. The first, second and third chambers may permit control of a pressure applied to the substrate in the annular region and control of an inner diameter and an outer diameter of the annular region. Pressurization of the first chamber may push the middle portion of the second flexible membrane away from the first flexible membrane to increase the inner diameter of the annular region, whereas evacuation of the first chamber may pull the middle portion of the second flexible membrane toward from the first flexible membrane to decrease the inner diameter of the annular region. Pressurization of the second chamber may push the middle portion of the second flexible membrane toward the first flexible membrane to decrease the inner diameter of the annular region, whereas evacuation of the second chamber may pull the middle portion of the second flexible membrane away from the first flexible membrane to increase the inner diameter of the annular region. Pressurization of the third chamber may push the middle portion of the second flexible membrane toward the first flexible membrane to increase the outer diameter of the annular region, whereas evacuation of the third chamber may pull the middle portion of the second flexible membrane away from the first flexible membrane to decrease the outer diameter of the annular region. The central portion of the first flexible membrane may have an aperture, and a clamp may extend through the aperture to secure the first flexible membrane to the carrier structure. The clamp may include a passage to fluidly connect the first chamber to a pressure source.

Potential advantages of implementations of the invention may include zero or more of the following. Both the pressure and the loading area of the flexible membrane against the substrate may be varied to compensate for non-uniform polishing. The carrier head may apply pressure to the substrate in an annular loading area, and both the inner diameter and the outer diameter of the annular loading area may be controlled. The carrier head may either increase or decrease the pressure at the substrate center relative to the pressure on other portions of the substrate. Thus, non-uniform polishing of the substrate, such as the center-slow effect, may be reduced, and the resulting flatness and finish of the substrate may be improved.

Other advantages and features of the invention will be apparent from the following description, including the drawings and claims.

BRIEF DESCRIPTION OF THE DRAWINGS

Like reference numbers are designated in the various drawings to indicate like elements.

DETAILED DESCRIPTION

Figure 1:
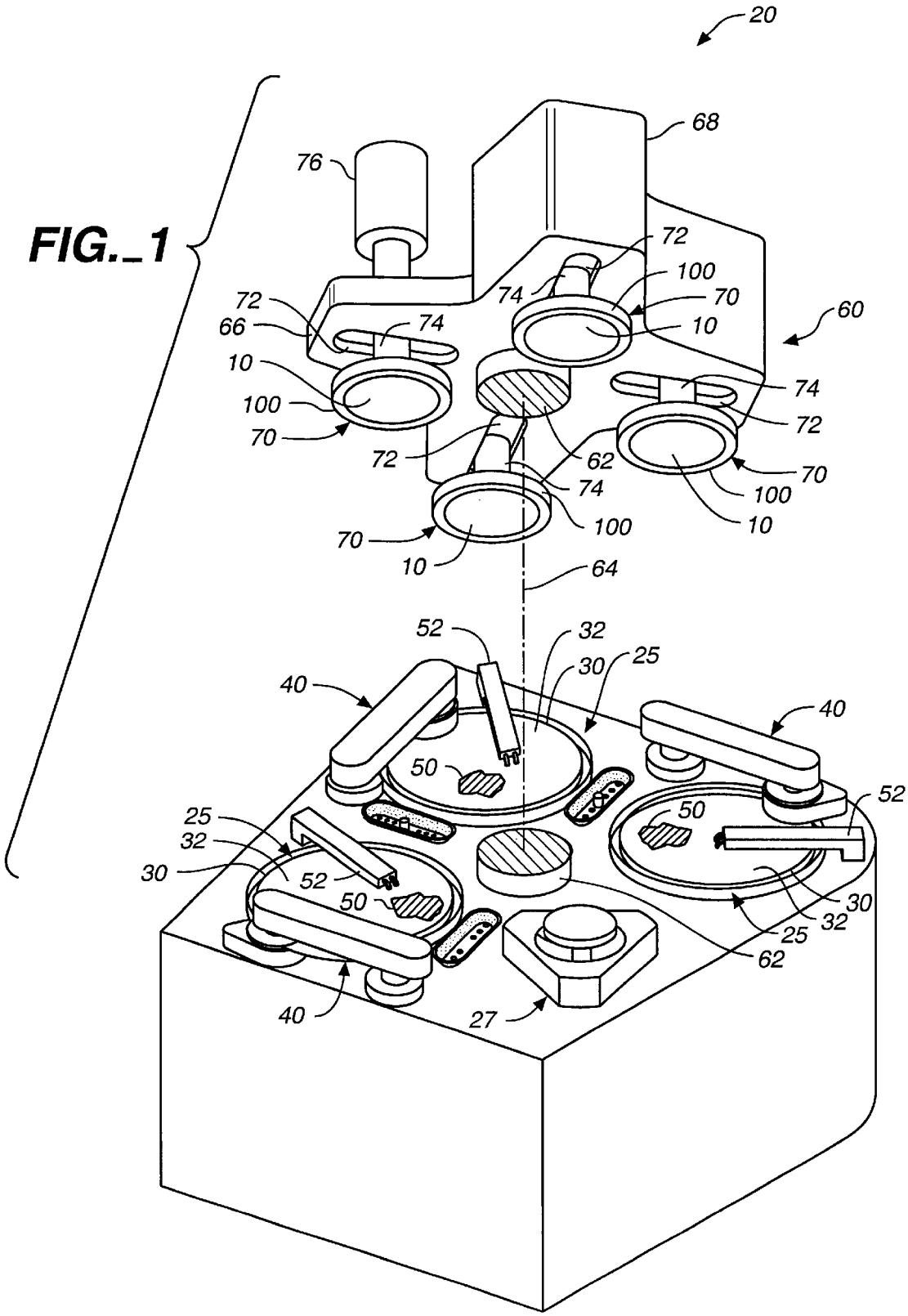
FIG. 1 is an exploded perspective view of a chemical mechanical polishing apparatus.

Referring to FIG. 1, one or more substrates 10 will be polished by a chemical mechanical polishing (CMP) apparatus 20. A description of a suitable CMP apparatus may be found in U.S. Pat. No. 5,738,574, the entire disclosure of which is incorporated herein by reference.

The CMP apparatus 20 includes a series of polishing stations 25 and a transfer station 27 for loading and unloading the substrates. Each polishing station 25 includes a rotatable platen 30 on which is placed a polishing pad 32. Each polishing station 25 may further include an associated pad conditioner apparatus 40 to maintain the abrasive condition of the polishing pad.

A slurry 50 containing a liquid (e.g., deionized water for oxide polishing) and a pH adjuster (e.g., potassium hydroxide for oxide polishing) may be supplied to the surface of the polishing pad 32 by a combined slurry/rinse arm 52. If the polishing pad 32 is a standard pad, the slurry 50 may also include abrasive particles (e.g., silicon dioxide for oxide polishing). On the other hand, if the polishing pad 32 is a fixed-abrasive pad, the slurry 50 may be an abrasiveless liquid. Typically, sufficient slurry is provided to cover and wet the entire polishing pad 32. The slurry/rinse arm 52 includes several spray nozzles (not shown) to provide a high pressure rinse of the polishing pad 32 at the end of each polishing and conditioning cycle.

A rotatable multi-head carousel 60 is supported by a center post 62 and rotated thereon about a carousel axis 64 by a carousel motor assembly (not shown). The multi-head carousel 60 includes four carrier head systems 70 mounted on a carousel support plate 66 at equal angular intervals about the carousel axis 64. Three of the carrier head systems position substrates over the polishing stations, and one of the carrier head systems receives a substrate from and delivers the substrate to the transfer station. The carousel motor may orbit the carrier head systems, and the substrates attached thereto, about the carousel axis between the polishing stations and the transfer station.

Each carrier head system 70 includes a polishing or carrier head 100. Each carrier head 100 independently rotates about its own axis, and independently laterally oscillates in a radial slot 72 formed in the carousel support plate 66. A carrier drive shaft 74 extends through the slot 72 to connect a carrier head rotation motor 76 (shown by the removal of one-quarter of a carousel cover 68) to the carrier head 100. Each motor and drive shaft may be supported on a slider (not shown) which can be linearly driven along the slot by a radial drive motor to laterally oscillate the carrier head 100.

During actual polishing, three of the carrier heads are positioned at and above the three polishing stations. Each carrier head 100 lowers a substrate into contact with the polishing pad 32. The carrier head 100 holds the substrate in position against the polishing pad and distributes a force across the back surface of the substrate. The carrier head 100 also transfers torque from the drive shaft 74 to the substrate.

Figure 2:
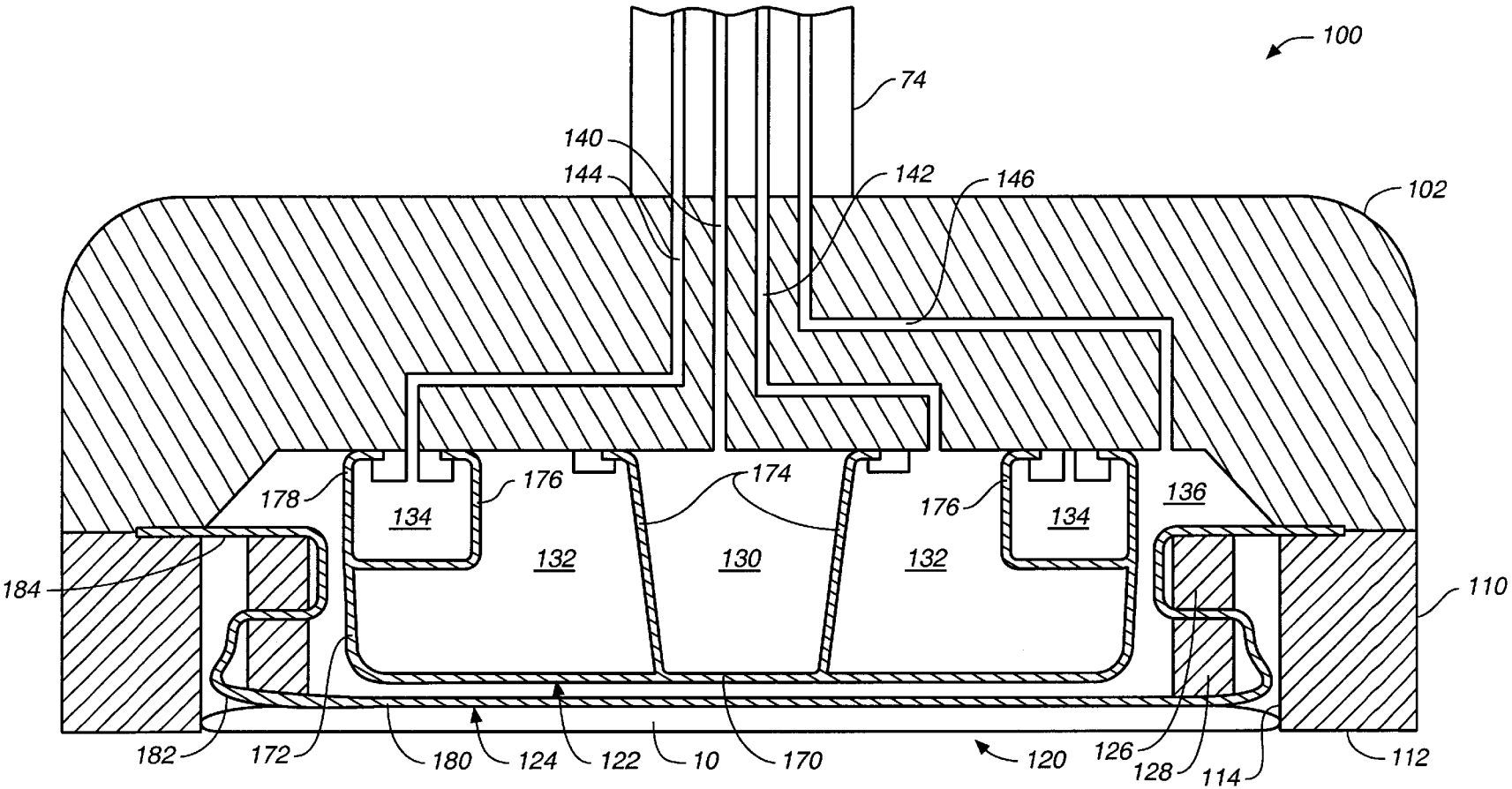
FIG. 2 is a schematic cross-sectional view of a carrier head according to the present invention.

Referring to FIG. 2, the carrier head 100 includes a housing 102, a retaining ring 110, and a substrate backing assembly 120 which includes four pressurizable chambers, such as a first internal chamber 130, a second internal chamber 132, a third internal chamber 134, and an external chamber 136. Although unillustrated, the housing can include a first section secured to the drive shaft and a vertically movable second section (a base assembly) suspended from the first section. For example, the base assembly can be connected to the housing by a separate loading chamber that controls the pressure of the retaining ring on the polishing surface. In addition, the carrier head can also include other features, such as a gimbal mechanism (which may be considered part of the base assembly). A description of a similar carrier head with these features may be found in U.S. patent application Ser. No. 09/470,820, filed Dec. 23, 1999, the entire disclosure of which is incorporated herein by reference.

The housing 102 can be connected to the drive shaft 74 (see FIG. 1) to rotate therewith during polishing about an axis of rotation which is substantially perpendicular to the surface of the polishing pad. The housing 102 may be generally circular in shape to correspond to the circular configuration of the substrate to be polished. Four passages 140, 142, 144 and 146 can extend through the housing 102 for pneumatic control of the chambers 130, 132, 134 and 136, respectively. If the substrate backing assembly is suspended from a base assembly by a loading chamber, a fifth passage through the housing can be used to control the pressure in the loading chamber, and passages in the base assembly can be connected to the passages in the housing by flexible tubing that extends through the loading chamber.

The retaining ring 110 may be a generally annular ring secured at the outer edge of the housing 102. A bottom surface 112 of the retaining ring 110 may be substantially flat, or it may have a plurality of channels to facilitate transport of slurry from outside the retaining ring to the substrate. An inner surface 114 of the retaining ring 110 engages the substrate to prevent it from escaping from beneath the carrier head.

Still referring to FIG. 2, the substrate backing assembly 120 includes an inner membrane 122, an outer membrane 124, an upper membrane spacer ring 126, and a lower membrane spacer ring 128. The inner and outer membranes 122 and 124 can be formed of a flexible material, such as an elastomer, e.g., chloroprene or ethylene propylene rubber or silicone, an elastomer coated fabric, a thermal plastic elastomer (TPE), or a combination of these materials. The bottom surface of a central portion of the inner membrane 122 or the top surface of a central portion of the outer membrane 124 can have small grooves to ensure that fluid can flow therebetween and/or a textured rough surface to prevent adhesion when the internal and outer membranes are in contact. Different portions of the inner and outer membranes 122 and 124 may formed of materials with different stiffness or have different thicknesses.

The outer membrane 124 includes a central portion 180 that provides a mounting surface to engage the substrate, a lip portion 182, and a perimeter portion 184 that extends between upper the upper membrane spacer ring 126 and the lower membrane spacer ring 128 to be secured to the base assembly, e.g., to be clamped between the housing 102 and the retaining ring 110. The outer membrane 124 may be pre-molded into a serpentine shape. The lip portion 182 can operate to provide an active-flap lip seal during chucking of the substrate, as discussed in U.S. patent application Ser. No. 09/296,935, filed Apr. 22, 1999, the entirety of which in incorporated herein by reference.

The inner membrane 122 includes a circular central portion 170 that will contact the external membrane 152 in a controllable area, a perimeter portion 172 with an inner edge that is connected to the outer edge of the central portion 170, an inner annular flap portion 174 connected to the central portion 170, a middle annular flap portion 176 that extends from the outer edge of the perimeter portion 172, and an outer annular flap portion 178 that also extends from the outer edge of the perimeter portion 172. The rim of each annular flap 174, 176 and 178 can be clamped to the housing or base assembly by a clamp ring.

The volume between the housing 102 and the inner membrane 122 that is sealed by the inner flap 174 provides the first internal chamber 130. The annular volume between the housing 102 and the inner membrane 122 that is sealed between the inner flap 176 and the middle flap 176 defines the second internal chamber 132. The annular volume between the housing 102 and the inner membrane 122 that is sealed between the middle flap 176 and the outer flap 178 defines the third internal chamber 134. Finally, the sealed volume between the inner membrane 122 and the outer membrane 124 defines the external chamber 136. Each chamber may be connected to an unillustrated pump to independently control the pressure in the associated chamber. As explained in greater detail below, the combination of pressures in the chambers 130, 132, 134 and 136 control both the contact area and the pressure of the inner membrane 122 against the top surface of the outer membrane 124.

The upper membrane spacer ring 126 is a generally rigid annular body located between retaining ring 110 and outer membrane 124. The lower membrane spacer ring 128 is a generally rigid annular body located inside the external chamber 136 below the upper membrane spacer ring 162. The upper and lower membrane spacer rings 128 serve to form the perimeter portion 184 of the outer membrane 128 into a general serpentine cross-sectional shape. The upper and lower spacer rings 126 and 128 need not be secured to the rest of the carrier head, and may be held in place by the inner and outer membranes. The membrane spacer rings may have other shapes selected to affect the distribution of pressure at the substrate edge.

As discussed above, a controllable region of the central portion 170 of the inner membrane 122 can contact and apply a downward load to an upper surface of the outer membrane 124. The load is transferred through the external membrane to the substrate in the loading area. In operation, fluid is pumped into or out of the floating internal chamber 156 to control the downward pressure of the internal membrane 150 against the external membrane 152 and thus against the substrate, and fluid is pumped into or out of the floating upper chamber 154 to control the contact area of the internal membrane 150 against the external membrane 152.

Figure 3A:
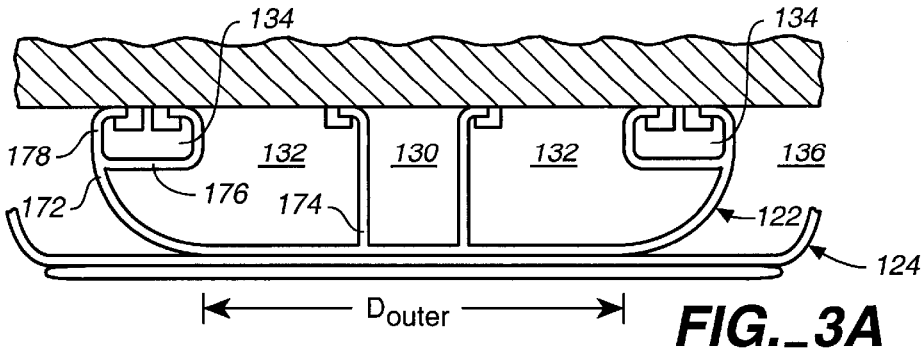
FIGS. 3A–3D are schematic cross-sectional views illustrating a controllable diameter of a loading area of the carrier head of FIG. 2.
Figure 3B:
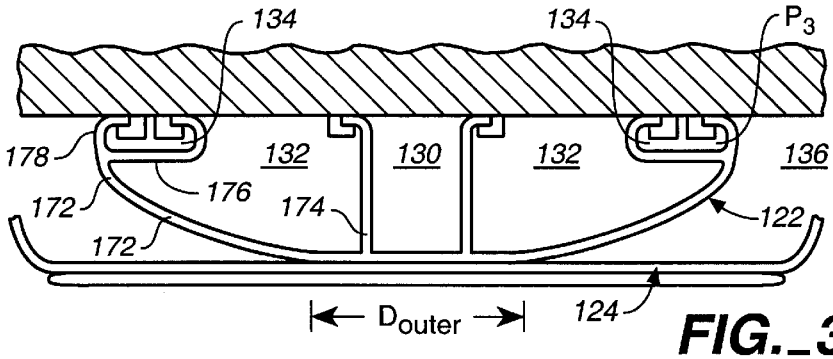
Figure 3C:
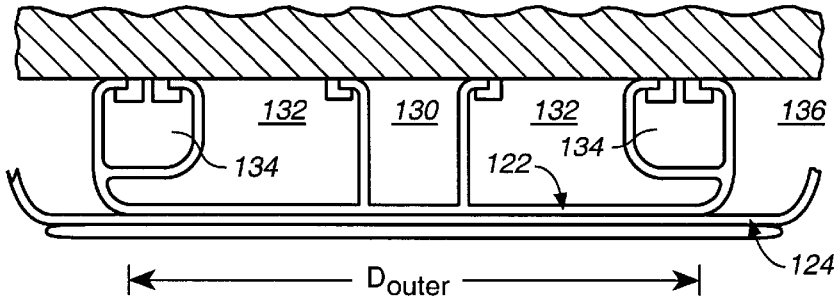

Referring to FIGS. 3A–3D, the contact area of the internal membrane 150 against the external membrane 152, and thus the loading area in which pressure is applied to the substrate 10, may be controlled by varying the pressure in the chambers 130, 132, 134 and 136. As shown in FIG. 3A, at some set of pressures, a circular region of the inner membrane 122 having an outer diameter $D_{outer}$ will contact the upper surface of the outer membrane. As shown in FIG. 3B, by pumping fluid out of the third internal chamber 134, the perimeter portion 172 of the inner membrane 122 is drawn upwardly, thereby pulling the outer edge of the central portion 170 away from the external membrane 152 and decreasing the diameter $D_{outer}$ of the loading area. Conversely, as shown in FIG. 3C, by pumping fluid into the third internal chamber 134, the perimeter portion 172 of the internal membrane 122 is forced downwardly, thereby lowering the edge of the central portion 170 of the internal membrane 150 into contact with the external membrane 152 and increasing the outer diameter $D_{outer}$ of the loading area. In sum, this permits the carrier head to operate with a controllable loading zone, as described in the aforementioned U.S. patent application Ser. No. 09/470,820. In addition, the pressure in the first internal chamber 130 can be adjusted to be higher or lower than the pressure in the second internal chamber 130.

Figure 3D:
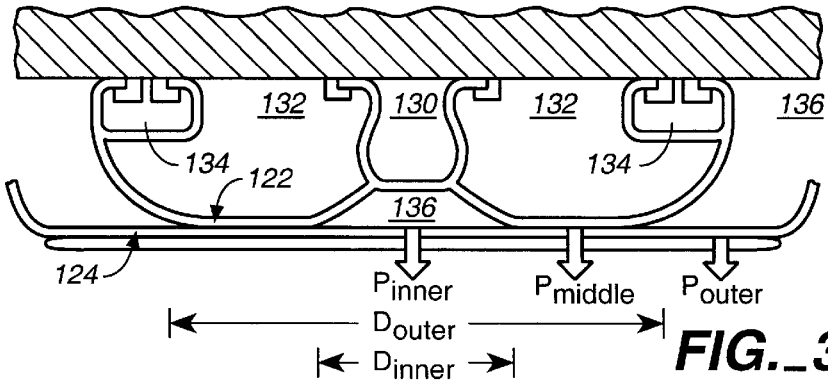

As shown in FIG. 3D, if sufficient fluid is pumped out of the first internal chamber 130, the center of the central portion 170 of the inner membrane 122 is drawn upwardly, creating an annular contact area between the inner membrane 122 and the outer membrane 124 having an inner diameter $D_{inner}$. Forcing additional fluid out of the first internal chamber 130 will increase the inner diameter $D_{inner}$ of the loading area, whereas pumping fluid into the first internal chamber 130 will decrease the inner diameter $D_{inner}$ of the loading area. The outer diameter $D_{outer}$ of the loading area can be adjusted as described above. In addition, pumping fluid into or out of the second internal chamber 134, will affect the pressure $P_{middle}$ applied to the substrate adjacent to the annular contact area. Thus, the carrier head 100 can apply a controllable uniform pressure to the substrate in an annular area, and the inner diameter $D_{inner}$, the outer diameter $D_{outer}$ and the applied pressure of the annular area can all be controlled by the pressures in the chambers 130, 132, 134 and 136. In addition, the pressure $P_{outer}$ applied to the annular area between the outer diameter $D_{outer}$ from the substrate edge can also be adjusted. Assuming grooves in the upper surface of the outer membrane 124 or the lower surface of the inner membrane 122 permit fluid flow, the pressure $P_{inner}$ applied to the central region of the substrate inside the inner diameter $D_{inner}$ can be equal to the outer pressure $P_{outer}$. Notably, this permits the substrate to apply a higher pressure to the region of the substrate bounded by the inner diameter $D_{inner}$ and the outer diameter $D_{outer}$ than the remainder of the substrate. In addition, these diameters can be adjusted while maintaining the applied pressure substantially constant.

Carrier head 100 may also be operated in a "standard" operating mode, in which the internal chambers 130, 132 and 134 are vented or evacuated to lift away from the substrate, and the outer chamber 136 is pressurized to apply a uniform pressure to the entire backside of the substrate.

Figure 4:
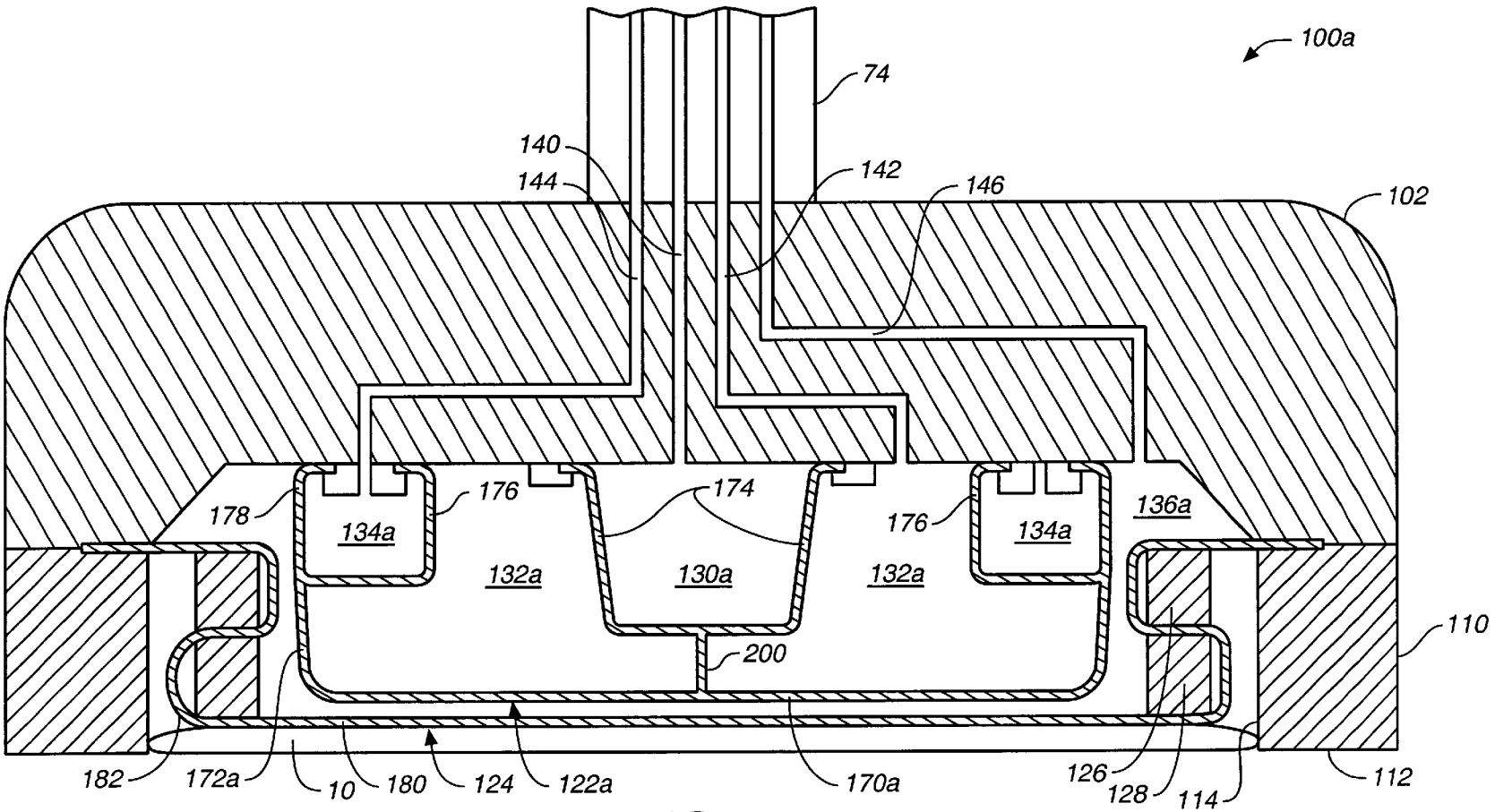
FIG. 4 is a schematic cross-sectional view of a carrier head in which the central portion of the inner membrane does not form a boundary of the first internal chamber.

Referring to FIG. 4, in another implementation, the inner membrane 122*a* of carrier head 100*a* includes a cylindrical connector portion 200 that secures the inner annular flap 174*a* to the center of central portion 170*a*. An advantage of this implementation is that it enables the carrier head 100*a* to form an annular contact region with a smaller inner diameter $D_{inner}$ than the implementation of carrier head 100.

Figure 5:
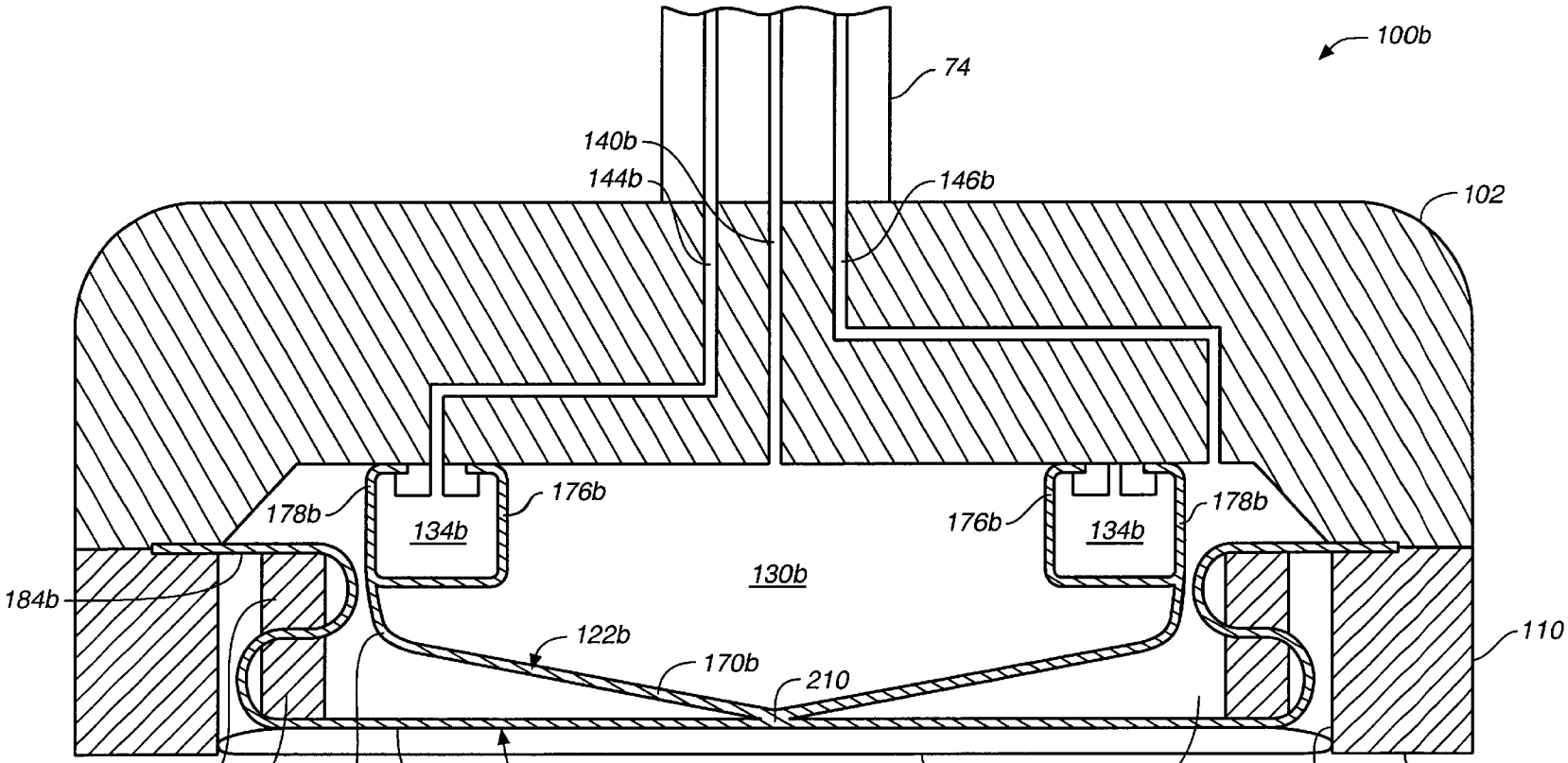
FIG. 5 is a schematic cross-sectional view of a carrier head in which the inner membrane is joined to the outer membrane.

Referring to FIG. 5, in another implementation, the carrier head 100*b* has an inner membrane 122*b* that is linked or joined to the outer membrane 124*b* to provide control of the inner diameter of the annular loading area. The joined section 210 of the two membranes 122*b* and 124*b* can be located at about the center of the membranes. In this implementation, the inner membrane 122*b* can include two annular flaps 176*b* and 178*b* rather than three annular flaps. The volume between the inner membrane 122*b* and the housing 102 sealed by the inner flap 176*b* forms a lower floating chamber 130*b*, whereas the annular volume between the inner membrane 122*b* and the housing 102 sealed by the inner flap 176*b* and the outer flap 178*b* forms an upper floating chamber 134*b*.

Figure 6A:
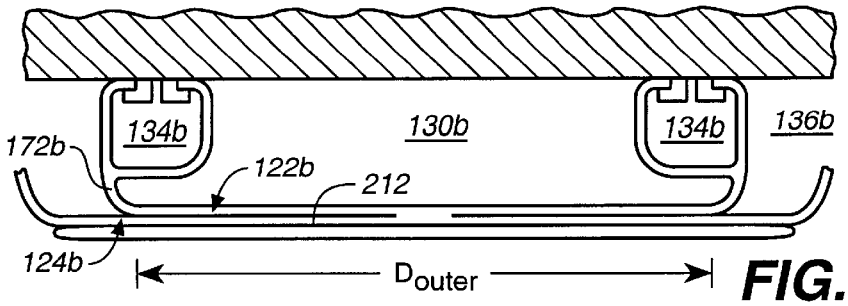
FIGS. 6A–6B are schematic cross-sectional views illustrating a controllable diameter of a loading area of the carrier head of FIG. 5.
Figure 6B:
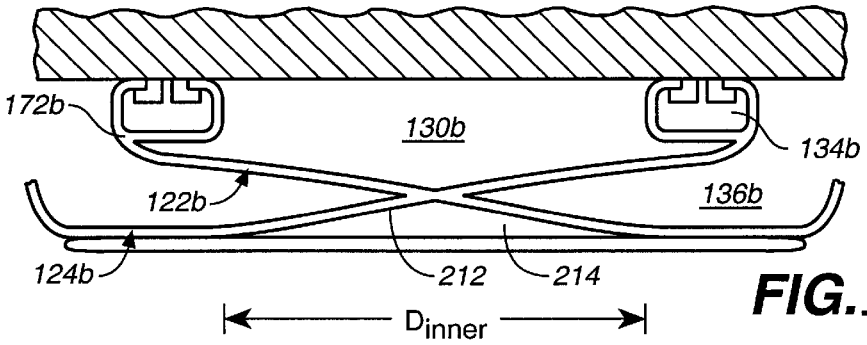

As shown in FIG. 6A, pumping fluid into the floating upper chamber 134*b* or floating lower chamber 130*b* forces the perimeter portion 172*b* of the inner membrane 122*b* downwardly, thereby generating a generally circular region of contact between the inner membrane 122*b* and the outer membrane 124*b* having an outer diameter $D_{outer}$. On the other hand, as shown in FIG. 6B, pumping fluid out of the floating upper chamber 134*b* and floating lower chamber 130*b* pulls the perimeter portion 172*b* away from the outer membrane 124*b*, thereby pulling a center portion 212 of the outer membrane 124*b* away from the substrate in a circular region having a diameter $D_{inner}$. This creates an annular pressure area on the substrate that extends from an inner diameter $D_{inner}$ to the substrate edge. Inside the annular area is a circular area at a lower pressure than the surrounding annular area. Thus, the carrier head 100*b* can apply pressure to the substrate in an annular area, and the inner diameter $D_{inner}$ and the applied pressure of the annular area can be controlled by the pressures in the chambers 130*b*, 134*b* and 136*b*. This implementation may need channels or grooves in a lower surface of the outer membrane 124*b* to vent the volume 214 between the outer membrane and the substrate to atmospheric pressure.

Figure 7:
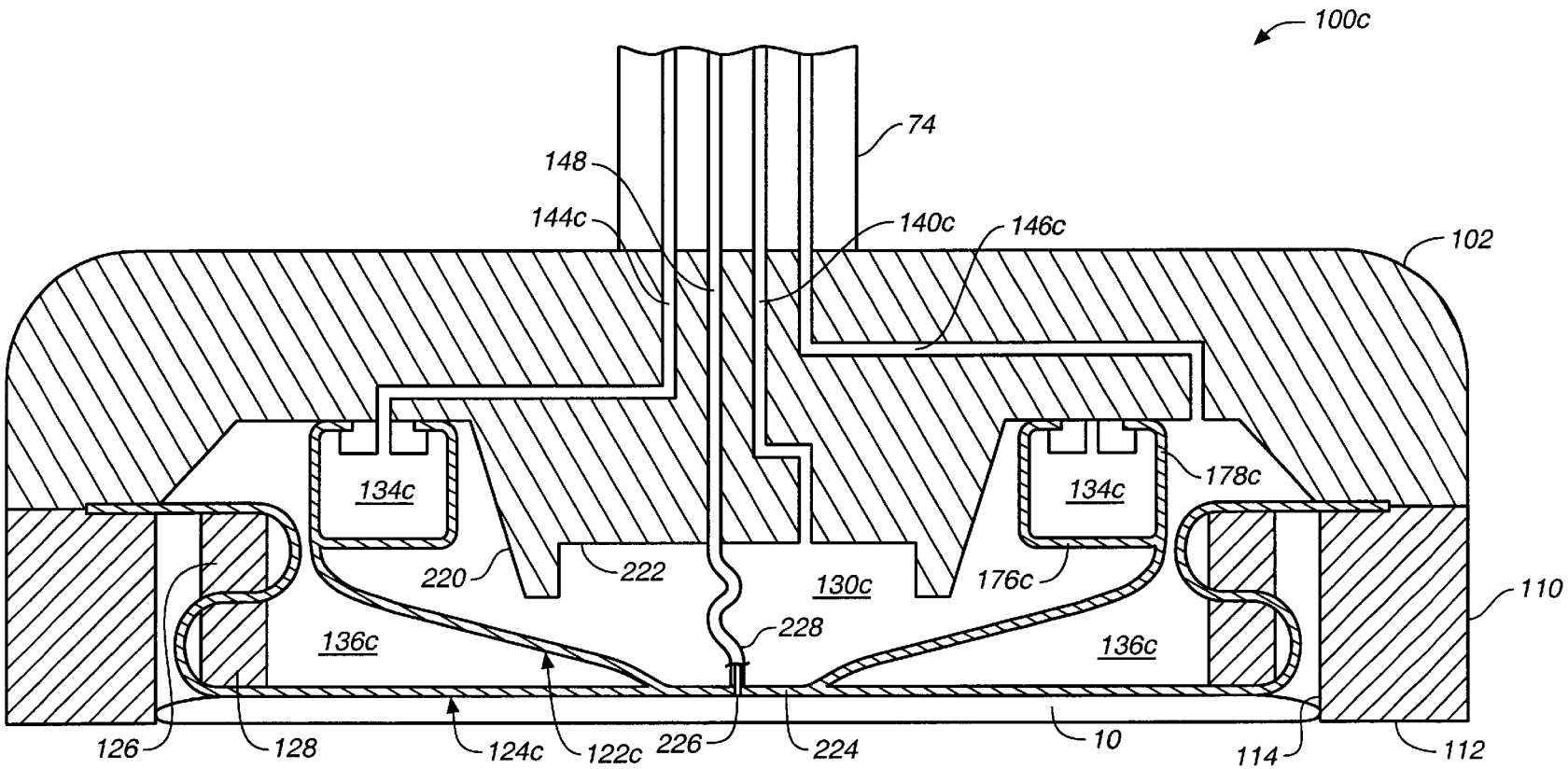
FIG. 7 is a schematic cross-sectional view of a carrier head in which the inner membrane is joined to the outer membrane and a fluid supply line can control a pressure in a volume between the substrate and outer membrane.

Referring to FIG. 7, in another implementation, the carrier head 100*c* has an inner membrane 122*c*, an outer membrane 122*c*, and a support structure 220 with a recess 222 in its lower surface. The support structure 220 may be part of the housing 102, or part of an unillustrated base assembly that is movably mounted to the housing. The inner membrane 122*c* is linked or joined to the outer membrane 124*c* in a circular region 224. In addition, an aperture 226 is formed in the circular region 224, and a flexible fluid supply line 228 is coupled to the aperture 226. The inner membrane 122*c* has an inner flap 176*c* and an outer flap 178*c* that are clamped to the support structure 220 to form an upper floating chamber 134*c*. The annular volume between the inner membrane 122*c* and the outer membrane 124*c* forms a membrane chamber 136*c*, and the volume between the inner membrane 122*b* and the housing 102 sealed by the inner flap 76*c* forms an internal chamber 130*c*. Passages 140*c*, 142*c*, 144*c* and 148 can extend through the support structure to provide pneumatic control of the chambers 130*c*, 132*c*, and 134*c* and the pressure to air supply line 228, respectively.

Figure 8A:
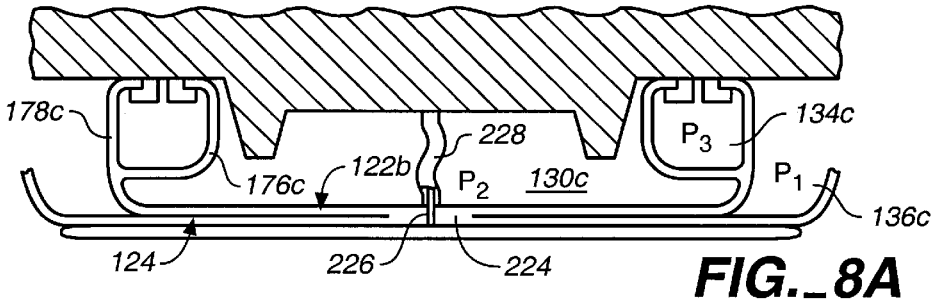
FIGS. 8A–8B are schematic cross-sectional views illustrating a controllable diameter of a loading area of the carrier head of FIG. 7.

Referring to FIG. 8A, if the pressure $P_2$ in the internal chamber 130*b* is greater than the pressure $P_1$ in the membrane chamber 136*c*, the inner membrane 124*c* is bowed outwardly to contact the outer membrane 124*c* in a circular region with a contact diameter $D_C$. By increasing the pressure $P_3$ in the upper floating chamber 134*c*, the inner membrane 122*c* is lifted away from the outer membrane 124*c*, thereby reducing the contact diameter $D_C$. On the other hand, by decreasing the pressure $P_3$ in the upper chamber 134*c*, the inner membrane 122*c* is lowered toward the outer membrane 124*c*, thereby increasing the contact diameter $D_C$.

Figure 8B:
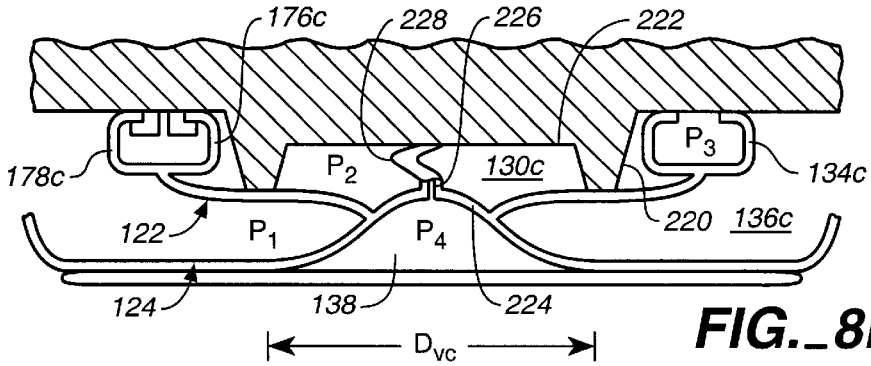

Referring to FIG. 8B, if the pressure $P_2$ in the membrane chamber 136*c* is greater than the pressure $P_1$ in the internal chamber, the inner membrane 124*c* bows inwardly to contact the support structure 220 and cover the recess 222. In addition, a center portion of the outer membrane 124*c* is pulled away from the substrate 10. The volume between the substrate 10 and outer membrane 124*c* forms a virtual chamber 138, and the pressure $P_4$ in the virtual chamber can be controlled by pumping fluid into or out of the fluid supply line 228. The pressure $P_4$ in the virtual chamber 138 is set to less than the pressure $P_1$ in the membrane chamber 136*c*. Thus, the carrier head 100*c* applies a first pressure $P_4$ to the substrate in a central region having a diameter $D_{VC}$, and applies a higher pressure $P_1$ to the substrate in an annular region surrounding the central region. This pressure distribution is particularly useful to counteract overpolishing of the substrate center (whether from polishing non-uniformity or from a substrate having a non-uniform incoming thickness).

In this configuration, the diameter $D_{VC}$ is given by the following equation:

$$\frac{D_{vc}}{D} = \sqrt{\frac{P_1 - P_2}{P_1 - P_4}}$$

where D is the diameter of the recess 222, and $P_1$, $P_2$ and $P_4$ are the pressures in the membrane chamber 136*c*, the internal chamber 130*c* and the virtual chamber 138, respectively. By varying the pressures $P_1$, $P_2$ and $P_4$, both the applied pressure and the diameter $D_{VC}$ of the central pressure region can be varied.

Figure 9:
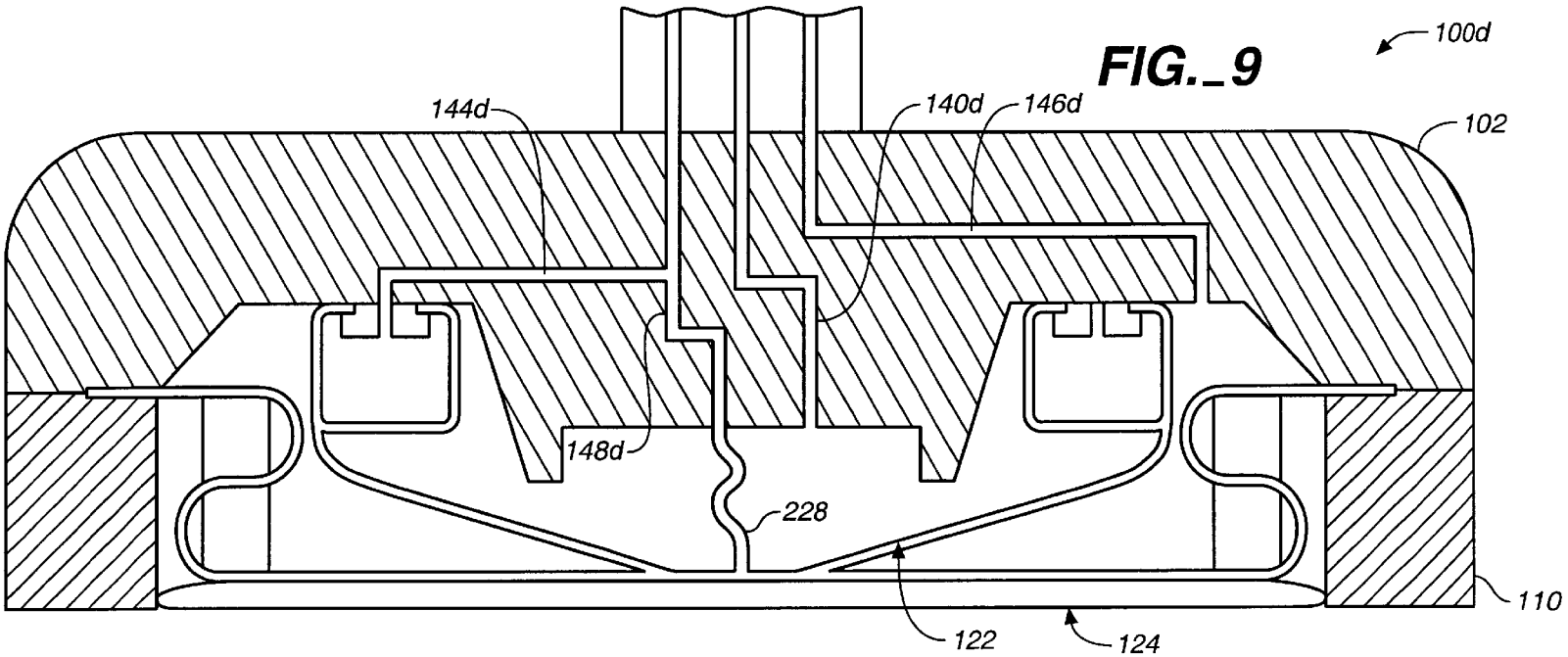
FIG. 9 is a schematic cross-sectional view of a carrier head in which the passages to the floating upper chamber and the fluid supply line are connected.
Figure 10:
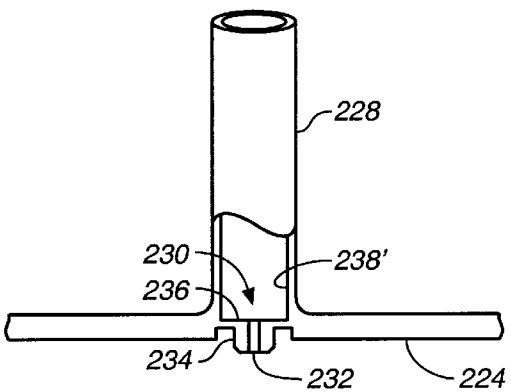
FIG. 10 is an enlarged view of the fluid supply line of the carrier head of FIG. 9.

If necessary (e.g., because only a limited number of fluid connections are available in the rotary coupling that connects the drive shaft to the stationary fluid source), the pneumatic controls to upper floating chamber 134*c* and the fluid supply line 228 may be shared. For example, referring to FIG. 9, passages 148 may be connected to passage 144*c*. In this case, referring to FIG. 10, a valve 230 can be formed in the lower end of the fluid supply line 228. The valve 230 includes a central orifice 232 through a cylindrical body 234, and an annular flexure 236 that connects the cylindrical body 234 to the inner surface 238 of the fluid supply line 228. The valve 230 blocks fluid flow when the pressure in the floating upper chamber 134*c* is greater than the pressure in the internal chamber 130*c*.

Figure 11:
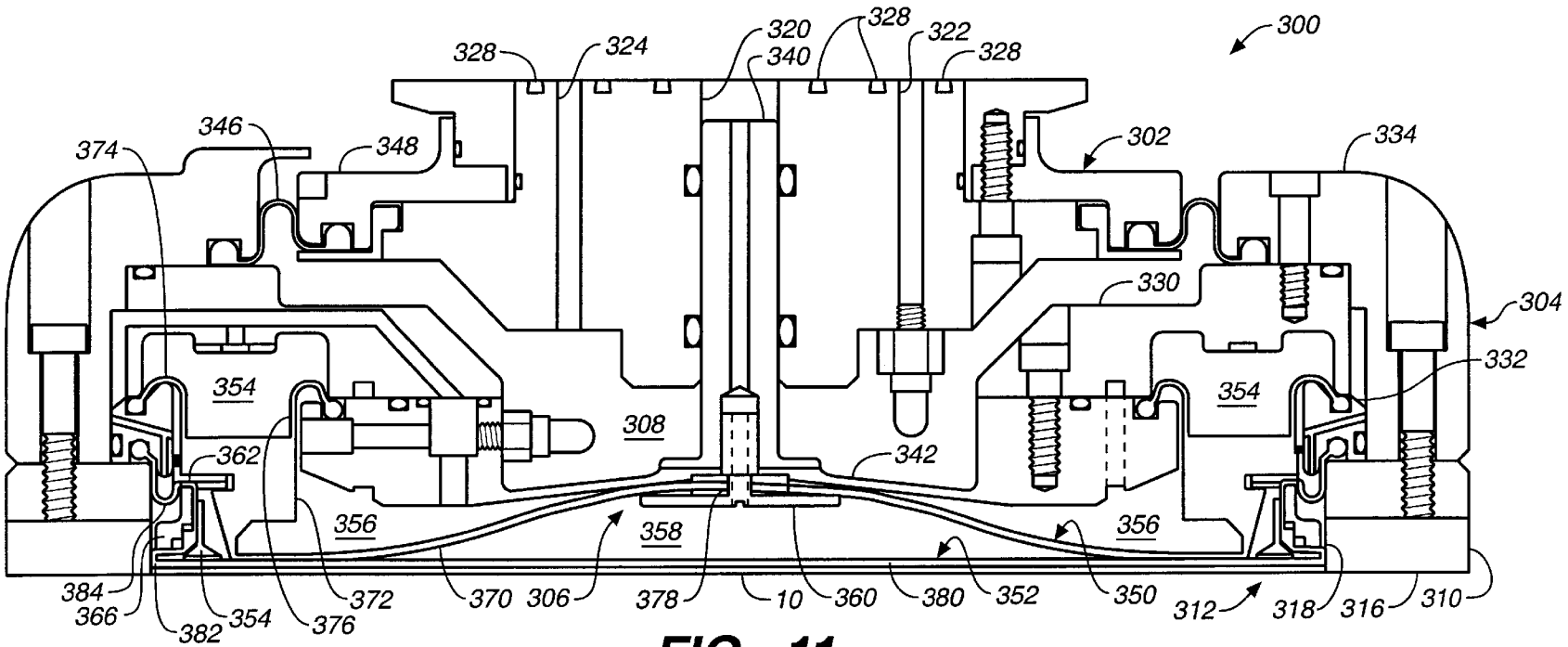
FIG. 11 is a schematic cross-sectional view of a carrier head according to the present invention.
Figure 12A:
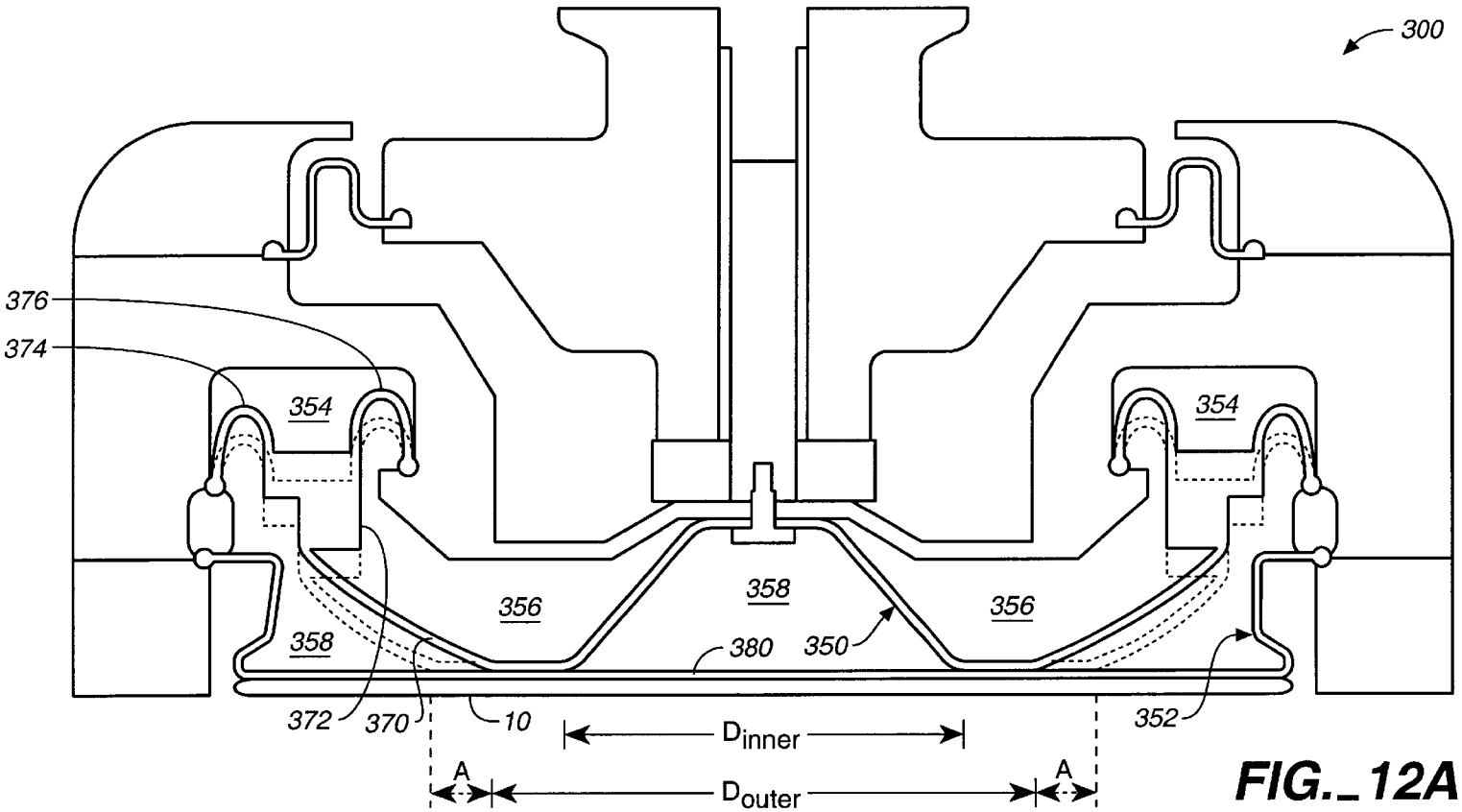
FIGS. 12A–12D are schematic illustrations of the membrane from the carrier head of FIG. 1 illustrating the controllable loading area.
Figure 12B:
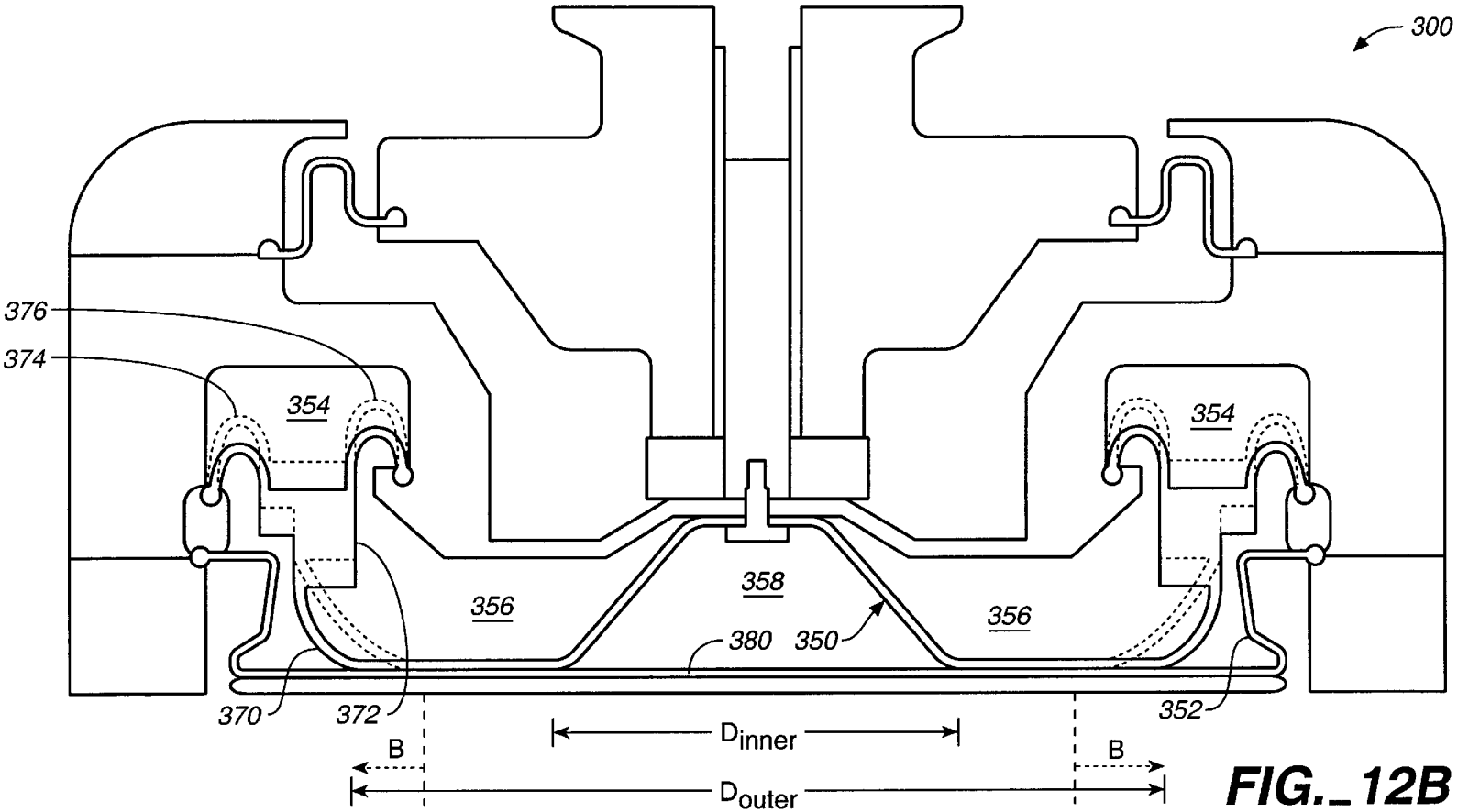
Figure 12C:
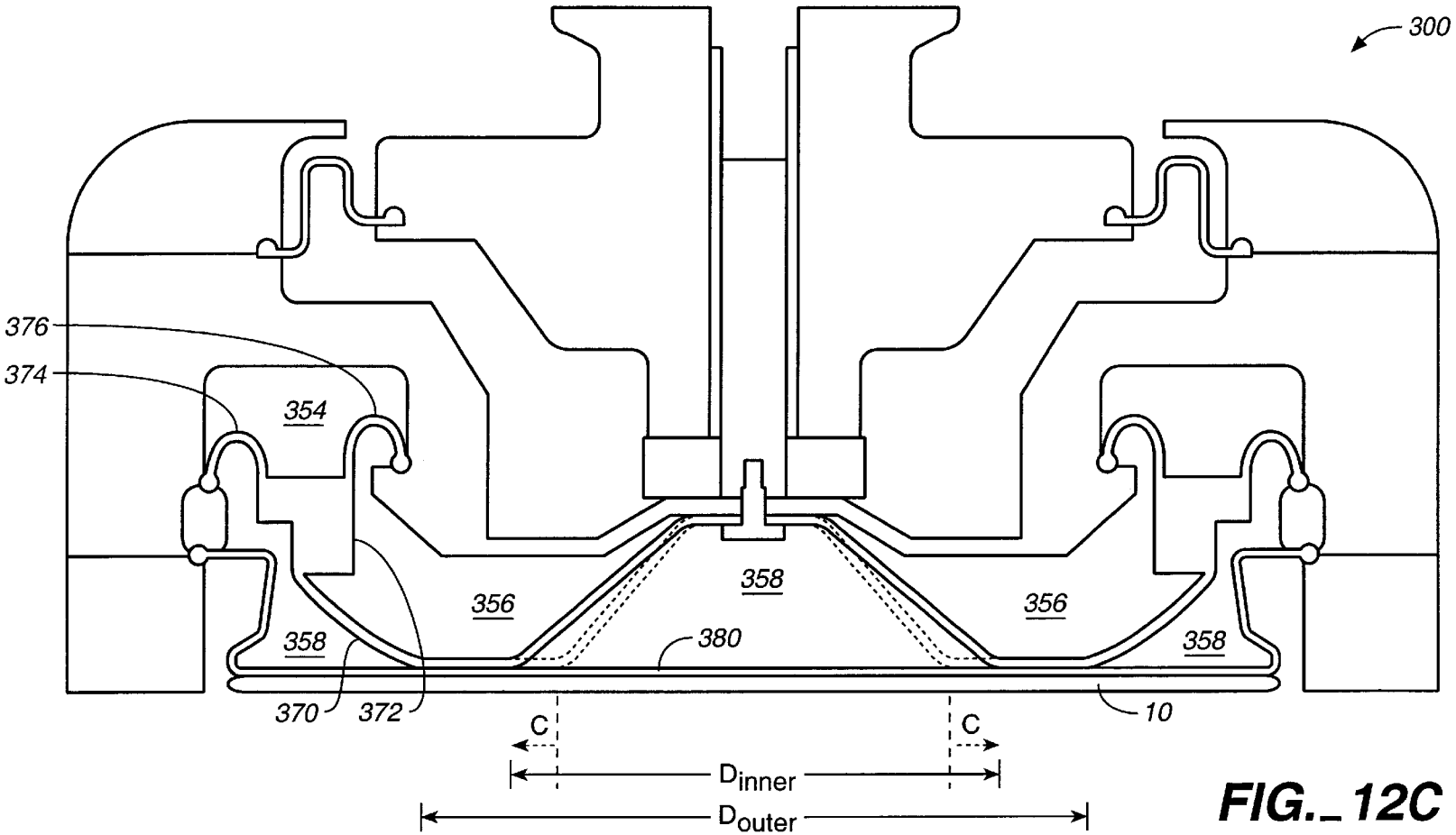
Figure 12D:
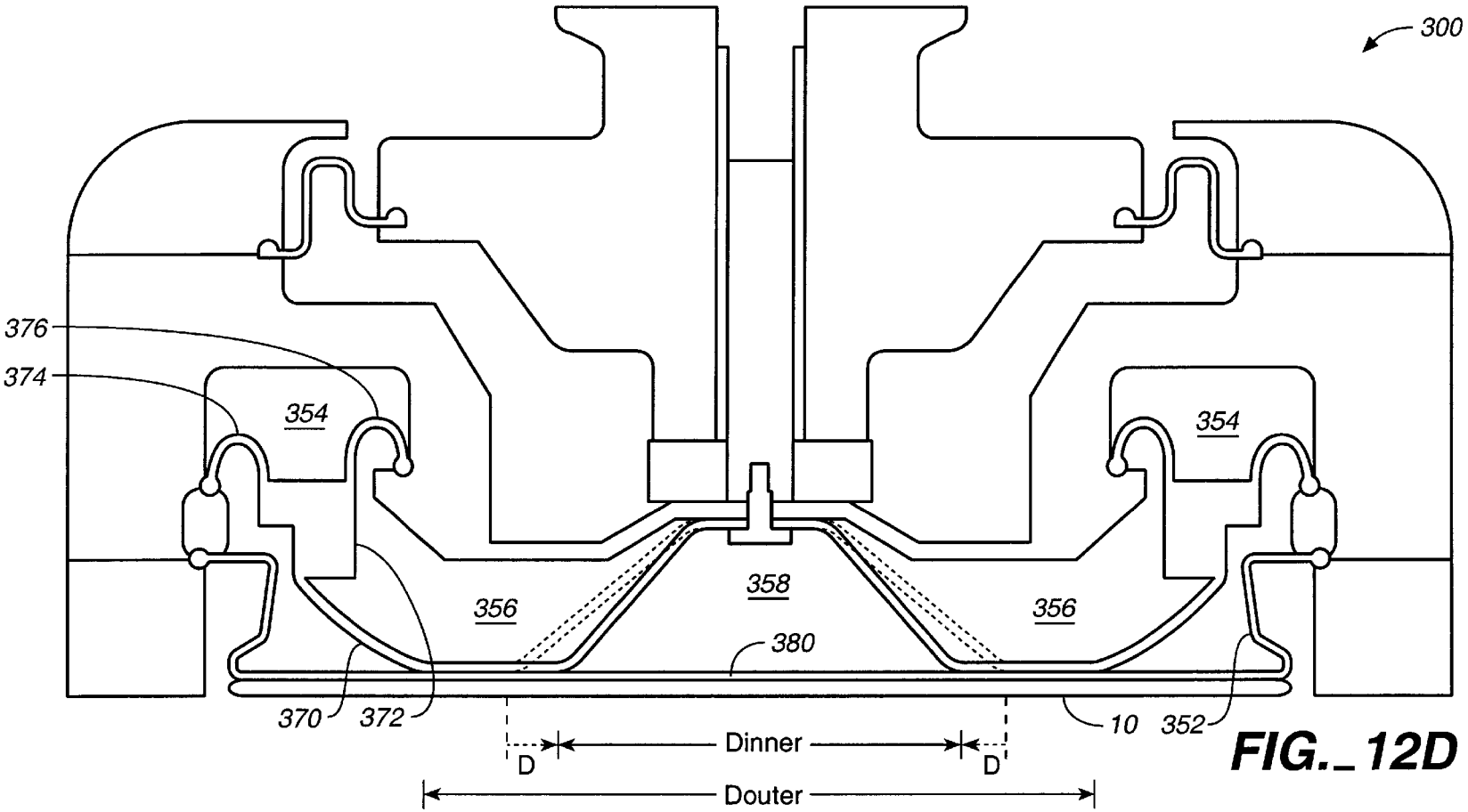

Referring to FIG. 11, in another implementation, the carrier head 300 includes a housing 302, a base assembly 304, a gimbal mechanism 306 (which may be considered part of the base assembly), a loading chamber 308, a retaining ring 310, and a substrate backing assembly 312 which includes three pressurizable chambers, such as an upper chamber 354, an inner chamber 356, and an outer chamber 358. Descriptions of similar carrier heads may be found in U.S. patent application Ser. No. 09/470,820, filed Dec. 23, 1999, Ser. No. 09/536,249, filed Mar. 27, 2000, and Ser. No. 60/217,633, filed Jul. 11, 2000, the entire disclosures of which are incorporated herein by reference.

The housing 302 can be generally circular in shape and can be connected to a drive shaft to rotate therewith during polishing. A vertical bore 320 may be formed through the housing 102, and three additional passages (only two passages 322, 324 are illustrated in FIG. 11) may extend through the housing 302 for pneumatic control of the carrier head. O-rings 328 may be used to form fluid-tight seals between the passages through the housing and the passages through the drive shaft.

The base assembly 304 is a vertically movable assembly located beneath the housing 302. The base assembly 334 includes a generally rigid annular body 330, an outer clamp ring 334, the gimbal mechanism 306, a lower clamp ring 332, and a membrane clamp 360. The gimbal mechanism 306 includes a gimbal rod 340 which slides vertically along bore 320 to provide vertical motion of the base assembly 304, a flexure ring 342 which bends to permit the base assembly 304 to pivot with respect to the housing so that the retaining ring may remain substantially parallel with the surface of the polishing pad. The membrane clamp 360 can be secured to the bottom surface of the gimbal rod 340 and flexure ring 342.

The loading chamber 308 is located between the housing 302 and the base assembly 304 to apply a load, i.e., a downward pressure or weight, to the base assembly 304. The vertical position of the base assembly 304 relative to the polishing pad 32 is also controlled by the loading chamber 308. An inner edge of a generally ring-shaped rolling diaphragm 346 may be clamped to the housing 302 by an inner clamp ring 348. An outer edge of the rolling diaphragm 346 may be clamped to the base assembly 304 by the outer clamp ring 334.

The retaining ring 310 may be a generally annular ring secured at the outer edge of the base assembly 304. When fluid is pumped into the loading chamber 308 and the base assembly 304 is pushed downwardly, the retaining ring 310 is also pushed downwardly to apply a load to the polishing pad 32. A bottom surface 316 of the retaining ring 310 may be substantially flat, or it may have a plurality of channels to facilitate transport of slurry from outside the retaining ring to the substrate. An inner surface 318 of the retaining ring 310 engages the substrate to prevent it from escaping from beneath the carrier head.

The substrate backing assembly 312 includes an internal membrane 350, an external membrane 352, an upper membrane spacer ring 362, a lower membrane spacer ring 364, and an edge control ring 366.

The internal and external membranes 350 and 352 can be formed of a flexible material, such as an elastomer, e.g., chloroprene or ethylene propylene rubber or silicone, an elastomer coated fabric, a thermal plastic elastomer (TPE), or a combination of these materials. The bottom surface of a central portion of the internal membrane 350 and/or the top surface of a central portion of the external membrane 352 can have small grooves to ensure that fluid can flow therebetween and/or a textured rough surface to prevent adhesion when the internal and outer membranes are in contact. Different portions of the internal and external membranes 350 and 352 may formed of materials with different stiffness or have different thicknesses.

The external membrane 350 includes a central portion 380 that provides a mounting surface to engage the substrate, a lip portion 382, and a perimeter portion 384 that extends in a convoluted path between the spacer rings 362, 364 and 366 to be secured to the base assembly, e.g., to be clamped between the housing 302 and the retaining ring 310. The lip portion 382 can operate to provide an active-flap lip seal during chucking of the substrate, as discussed in U.S. patent application Ser. No. 09/296,935, filed Apr. 22, 1999, the entirety of which in incorporated herein by reference.

The internal membrane 350 includes a central portion 370 that will contact the upper surface of the external membrane 352 in a controllable annular area, a relatively thick annular portion 372, an annular outer flap 374 that extends from the outer rim of the thick portion 372, and an annular inner flap 376 that extends from the inner edge of the thick portion 372. The rim of the inner and outer annular flaps 374 and 376 are clamped to the base assembly. An aperture 378 may be formed in the center of the central portion 370, and the membrane clamp 360 extends through the aperture 378 to clamp the center of the internal membrane 350 to the base assembly 304.

The volume between the housing 302 and the internal membrane 350 that is sealed by the inner flap 374 provides the inner chamber 356. The annular volume between the housing 302 and the internal membrane 350 that is sealed between the inner flap 376 and the outer flap 376 defines the upper chamber 354. Finally, the sealed volume between the internal membrane 350 and the external membrane 352 defines the outer chamber 358. Each chamber can be connected by various passages through the base assembly 304 and housing 302 to a pump or pressure source to independently control the pressure in the associated chamber. As explained in greater detail below, the combination of pressures in the chambers 354, 356, 358 control both the contact area and the pressure of the internal membrane 350 against the top surface of the external membrane 352.

The upper membrane spacer ring 362 is a generally annular rigid body which located in the outer chamber 358 between the internal and external membranes 350 and 352. The lower membrane spacer ring 364 is a generally annular rigid body located inside the outer chamber 358, below the upper membrane spacer ring 362. The edge control ring 366 is also a generally annular rigid member positioned between the retaining ring 310 and the external membrane 352. The upper membrane spacer ring 362, lower membrane spacer ring 364 and edge control ring 366 are discussed in aforementioned U.S. patent application Ser. No. 09/536,249.

As discussed above, a controllable annular region of the central portion 370 of the internal membrane 350 can contact an upper surface of the external membrane 352. In this contact area, the pressure in the inner chamber 356 applies a downward load to an upper surface of the external membrane 352. This load is transferred through the external membrane to the substrate in the controllable loading area. On the remainder of the substrate, the applied load is determined by the pressure in the outer chamber 358.

Referring to FIGS. 2A–2D, the contact area of the internal membrane 350 against the external membrane 352, and thus the loading area in which pressure is applied to the substrate 10, may be controlled by varying the pressure in the chambers 354, 356 and 358. As shown in phantom, at some set of pressures, an annular region of the inner membrane 350 having will contact the upper surface of the outer membrane 352.

As shown in FIG. 2A, by forcing fluid into the outer chamber 358 or out of the upper chamber 354, the thick portion 372 of the internal membrane 350 is drawn upwardly, thereby pulling the outer edge of the central portion 370 away from the external membrane 352 and decreasing the outer diameter Douter of the loading area (as shown by arrow A) Conversely, as shown in FIG. 2B, by forcing fluid into the upper chamber 354 or out of the outer chamber 358, the thick portion 372 of the internal membrane 350 is forced downwardly, thereby lowering the edge of the central portion 370 of the internal membrane 350 toward the external membrane 352 and increasing the outer diameter Douter of the loading area (as shown by arrow B). The pressure in the internal chamber 356 can also be used to affect the outer diameter Douter of the loading area.

As shown in FIG. 2C, by forcing fluid into the lower chamber 358 or out of the inner chamber 356, the center of the central portion 370 of the internal membrane 350 is forced upwardly and outwardly, increasing the inner diameter Dinner of the loading area (as shown by arrow C). On the other hand, by forcing fluid out of the lower chamber 358 or into the inner chamber 356, the center of the central portion 370 of the internal membrane 350 is forced inwardly and downwardly, decreasing the inner diameter Dinner of the loading area (as shown by arrow D).

Thus, the carrier head 300 can apply a controllable uniform pressure to the substrate in an annular area, and the inner diameter Dinner, the outer diameter Douter and the applied pressure Pinner of the annular area can all be controlled by the pressures in the chambers 354, 356 and 358. In addition, the pressure Pouter applied to the region of the substrate inside the inner diameter Dinner of the annular area and to the region of the substrate outside the outer diameter Douter of the annular area can also be adjusted (the two regions can have the same pressure because the grooves in the upper surface of the outer membrane 324 or the lower surface of the inner membrane 322 permit fluid flow). With this carrier head, a lower pressure can be applied to the central region of the substrate inside the inner diameter Dinner, thereby reducing or eliminating the center-fast affect.

Carrier head 300 may also be operated in a "standard" operating mode, in which the inner and upper chamber 354 and 356 are vented or evacuated to lift away from the substrate, and the outer chamber 358 is pressurized to apply a uniform pressure to the entire backside of the substrate.

The configurations of the various elements in the carrier head, such as the flexible membranes, the spacer rings, the control ring and the support structure are illustrative and not limiting. A variety of configurations are possible for a carrier head that implements the invention. For example, the floating upper chamber can be either an annular or a solid volume. The chambers may be separated either by a flexible membrane, or by a relatively rigid backing or support structure. A support structure that is either ring-shaped or disk-shaped with apertures therethrough may be positioned in the outer chamber. The carrier head could be constructed without a loading chamber, and the base assembly and housing can be a single structure.

The present invention has been described in terms of a number of implementations. The invention, however, is not limited to the implementations depicted and described. Rather, the scope of the invention is defined by the appended claims.

What is claimed is:

1. A carrier head for a chemical mechanical polishing apparatus, comprising a carrier structure;

a first flexible membrane extending below the carrier structure, a bottom surface of the flexible membrane providing a substrate-mounting surface;

a second flexible membrane positioned between the first flexible membrane and the carrier structure, where the first flexible membrane contacts the second flexible membrane in an annular contact area and the inner diameter of the annular contact area forms the outer diameter of a first variably-sized volume between the first and second flexible membranes; and a plurality of chambers between the first flexible membrane, the second flexible membrane and the carrier structure, the plurality of chambers configured to apply a first pressure to a substrate in the annular contact area, and wherein the plurality of chambers permits control of the first pressure applied to the substrate in the annular contact area and control of the inner diameter of the annular contact area.

2. The carrier head of claim 1, wherein the plurality of chambers are configured to apply a second pressure to the substrate in a central loading area surrounded by the annular contact area.

3. The carrier head of claim 2, wherein the second pressure is less than the first pressure.

4. The carrier head of claim 1, wherein the second flexible membrane includes a first membrane portion which can be brought into contact with an inner surface of the first flexible membrane, and a second membrane portion connected to a central section of the first membrane portion and defining a first chamber between the carrier structure and the second membrane.

5. The carrier head of claim 4, wherein evacuation of the first chamber draws the second membrane portion upwardly and pulls the central section of the first membrane portion away from first flexible membrane to increase the inner diameter of the annular contact area between the second flexible membrane and the first flexible membrane.

6. The carrier head of claim 5, further comprising a third membrane portion connected to an edge section of the first membrane portion and defining a second chamber between the carrier structure and the second flexible membrane.

7. The carrier head of claim 6, wherein evacuation of the second chamber draws the third membrane portion upwardly and pulls the edge section of the first membrane portion away from the first flexible membrane to reduce an outer diameter of the annular contact area between the second flexible membrane and the first flexible membrane.

8. A carrier head for a chemical mechanical polishing apparatus, comprising:

a carrier structure;

a first flexible membrane having a perimeter portion connected to the carrier structure and a central portion with a lower surface that provides a substrate mounting surface;

a second flexible membrane having a central portion secured to the carrier structure, a perimeter portion secured to the carrier structure, an annular flap secured to the carrier structure, and a middle portion having a lower surface that contacts an upper surface of the central portion of the first flexible membrane in an annular region;

a first volume between the first flexible membrane and the second flexible membrane providing a first chamber;

a second volume between the second flexible membrane and the carrier structure inside the annular flap providing a second chamber; and a third volume between the second flexible membrane and the carrier structure between the annular flap and the perimeter portion providing a third chamber.

9. The carrier head of claim 8, wherein the first, second and third chambers permit control of a pressure applied to the substrate in the annular region and control of an inner diameter and an outer diameter of the annular region.

10. The carrier head of claim 9, wherein pressurization of the first chamber pushes the middle portion of the second flexible membrane away from the first flexible membrane to increase the inner diameter of the annular region.

11. The carrier head of claim 9, wherein evacuation of the first chamber pulls the middle portion of the second flexible membrane toward the first flexible membrane to decrease the inner diameter of the annular region.

12. The carrier head of claim 9, wherein pressurization of the second chamber pushes the middle portion of the second flexible membrane toward the first flexible membrane to decrease the inner diameter of the annular region.

13. The carrier head of claim 9, wherein evacuation of the second chamber pulls the middle portion of the second flexible membrane away from the first flexible membrane to increase the inner diameter of the annular region.

14. The carrier head of claim 9, wherein pressurization of the third chamber pushes the middle portion of the second flexible membrane toward the first flexible membrane to increase the outer diameter of the annular region.

15. The carrier head of claim 9, wherein evacuation of the third chamber pulls the middle portion of the second flexible membrane away from the first flexible membrane to decrease the outer diameter of the annular region.

16. The carrier head of claim 8, wherein the central portion of the first flexible membrane has an aperture, and a clamp extends through the aperture to secure the first flexible membrane to the carrier structure.

17. The carrier head of claim 16, wherein the clamp includes a passage to fluidly connect the first chamber to a pressure source.

* * * * *

UNITED STATES PATENT AND TRADEMARK OFFICE

CERTIFICATE OF CORRECTION

PATENT NO. : 6,722,965 B2
APPLICATION NO. : 09/903226
DATED : April 20, 2004
INVENTOR(S) : Hung Chih Chen, Ming Kuei Tseng and Steven M. Zuniga It is certified that error appears in the above-identified patent and that said Letters Patent is hereby corrected as shown below:

Title page,
Item [75], Inventors, change "Kuie" to -- Kuei --.

Signed and Sealed this

Twentieth Day of June, 2006

JON W. DUDAS
*Director of the United States Patent and Trademark Office*